US008346109B2

(12) United States Patent
Yamane

(10) Patent No.: US 8,346,109 B2
(45) Date of Patent: Jan. 1, 2013

(54) IMAGE FORMING APPARATUS WITH RESET OPERATION PROCESSING UNIT

(75) Inventor: Tsutomu Yamane, Tokyo (JP)

(73) Assignee: Oki Data Corporation, Tokyo (JP)

( * ) Notice: Subject to any disclaimer, the term of this patent is extended or adjusted under 35 U.S.C. 154(b) by 527 days.

(21) Appl. No.: 12/511,438

(22) Filed: Jul. 29, 2009

(65) Prior Publication Data

US 2010/0054770 A1 Mar. 4, 2010

(30) Foreign Application Priority Data

Aug. 29, 2008 (JP) ..... 2008-222037
Jul. 22, 2009 (JP) ..... 2009-171226

(51) Int. Cl.
*G03G 15/06* (2006.01)
*G03G 15/08* (2006.01)

(52) U.S. Cl. ..... 399/55; 399/285

(58) Field of Classification Search ..... 399/44, 399/55, 270, 285
See application file for complete search history.

(56) References Cited

U.S. PATENT DOCUMENTS 4,912,513 A * 3/1990 Oka et al. ..... 399/138
6,999,691 B2 * 2/2006 Lee ..... 399/55
7,068,967 B2 * 6/2006 Nakagawa ..... 399/232
7,433,617 B2 * 10/2008 Sheen ..... 399/55
7,835,676 B2 * 11/2010 Goto et al. ..... 399/270
7,885,563 B2 * 2/2011 Yamamura ..... 399/55
2005/0047808 A1 * 3/2005 Yamamura ..... 399/44
2009/0010666 A1 * 1/2009 Okuno et al. ..... 399/55

FOREIGN PATENT DOCUMENTS

JP 63237083 A * 10/1988
JP 01010281 A * 1/1989
JP 02124586 A * 5/1990
JP 02278273 A * 11/1990
JP 11-305501 11/1999
JP 2004245983 A * 9/2004
JP 2005055837 A * 3/2005
JP 2005-227730 A 8/2005
JP 2008076525 A * 4/2008
JP 2008089622 A * 4/2008

* cited by examiner

*Primary Examiner* — Robert Beatty
(74) *Attorney, Agent, or Firm* — Kubotera & Associates, LLC

(57) ABSTRACT

An image forming apparatus includes an image supporting member; a developer supporting member for attaching developer to a static latent image formed on a surface of the image supporting member; a developer layer forming member for forming a developer layer on the developer supporting member; a developer supply member for supplying developer to the developer supporting member; a developer supporting member voltage applying unit for applying a voltage to the developer supporting member; a developer supplying member voltage applying unit for applying a voltage to the developer supplying member; and a reset operation processing unit for setting a reset mode over a specific period of time, so that a bias difference in the reset mode between the voltage applied with the developer supporting member voltage applying unit and the voltage applied with the developer supplying member voltage applying unit becomes smaller than that in a printing mode.

17 Claims, 7 Drawing Sheets

IMAGE FORMING APPARATUS WITH RESET OPERATION PROCESSING UNIT

BACKGROUND OF THE INVENTION AND RELATED ART STATEMENT

The present invention relates to an image forming apparatus.

A conventional image forming apparatus such as a printer, a facsimile, an electro-photography color recording apparatus, and the likes is provided with an image forming unit. In the image forming unit, a charging roller uniformly charges a surface of a photosensitive drum. Then, an LED (Light Emitting Diode) head exposes the surface of the photosensitive drum to form a static latent image thereon. Afterward, a developing roller as a developer supporting member electrostatically attaches a thin layer of toner as developer to the static latent image, thereby forming a toner image. A transfer device transfers the toner image to a sheet as a recording medium, and a fixing device fixes the toner image to the sheet, thereby forming an image.

In the conventional image forming apparatus, a toner supplying roller is provided for supplying toner retained in a main body of the image forming unit or an image forming unit main body to the developing roller. To this end, a supply bias voltage is applied to the toner supply roller to generate a potential difference between the developing roller and the toner supply roller. The supply bias voltage is adjusted to control an amount of toner supplied to the developing roller, thereby adjusting a density of an image formed on the sheet, i.e., an image density (refer to Patent Reference). Further, an amount of toner supplied to the developing roller affecting image quality may also change according to an image forming condition such as an environmental condition where the printer is placed.

Patent Reference: Japan Patent Publication No. 11-305501

SUMMARY OF THE INVENTION

According to an aspect of the present invention, an image forming apparatus includes an image supporting member; a developer supporting member for attaching developer charged with a specific polarity to a static latent image formed on a surface of the image supporting member; a developer layer forming member for forming a developer layer on the developer supporting member; a developer supply member for supplying developer to the developer supporting member; a developer supporting member voltage applying unit for applying a voltage to the developer supporting member; a developer supplying member voltage applying unit for applying a voltage to the developer supplying member; and a reset operation processing unit for setting a reset mode over a specific period of time, so that a bias difference in the reset mode between the voltage applied with the developer supporting member voltage applying unit and the voltage applied with the developer supplying member voltage applying unit becomes smaller than that in a printing mode.

In the aspect of the present invention, the image forming apparatus includes the image supporting member; the developer supporting member for attaching developer charged with the specific polarity to the static latent image formed on the surface of the image supporting member; the developer layer forming member for forming the developer layer on the developer supporting member; the developer supply member for supplying developer to the developer supporting member; the developer supporting member voltage applying unit for applying the voltage to the developer supporting member; the developer supplying member voltage applying unit for applying the voltage to the developer supplying member; and the reset operation processing unit for setting the reset mode over the specific period of time, so that the bias difference in the reset mode between the voltage applied with the developer supporting member voltage applying unit and the voltage applied with the developer supplying member voltage applying unit becomes smaller than that in the printing mode.

In the aspect of the present invention, the reset operation processing unit is provided for setting the reset mode over the specific period of time, so that the bias difference in the reset mode between the voltage applied with the developer supporting member voltage applying unit and the voltage applied with the developer supplying member voltage applying unit becomes smaller than that in the printing mode. Accordingly, it is possible to prevent an amount of developer attached to the developer supporting member from excessively increasing. As a result, it is possible to prevent developer from attaching to an area of a medium where an image is not formed, thereby improving image quality.

DETAILED DESCRIPTION OF THE PREFERRED EMBODIMENTS

Hereunder, embodiments of the present invention will be described in detail with reference to the accompanying drawings. In the following description, the present invention is applied to a printer as an image forming apparatus, and is not limited thereto.

First Embodiment

Figure 1:
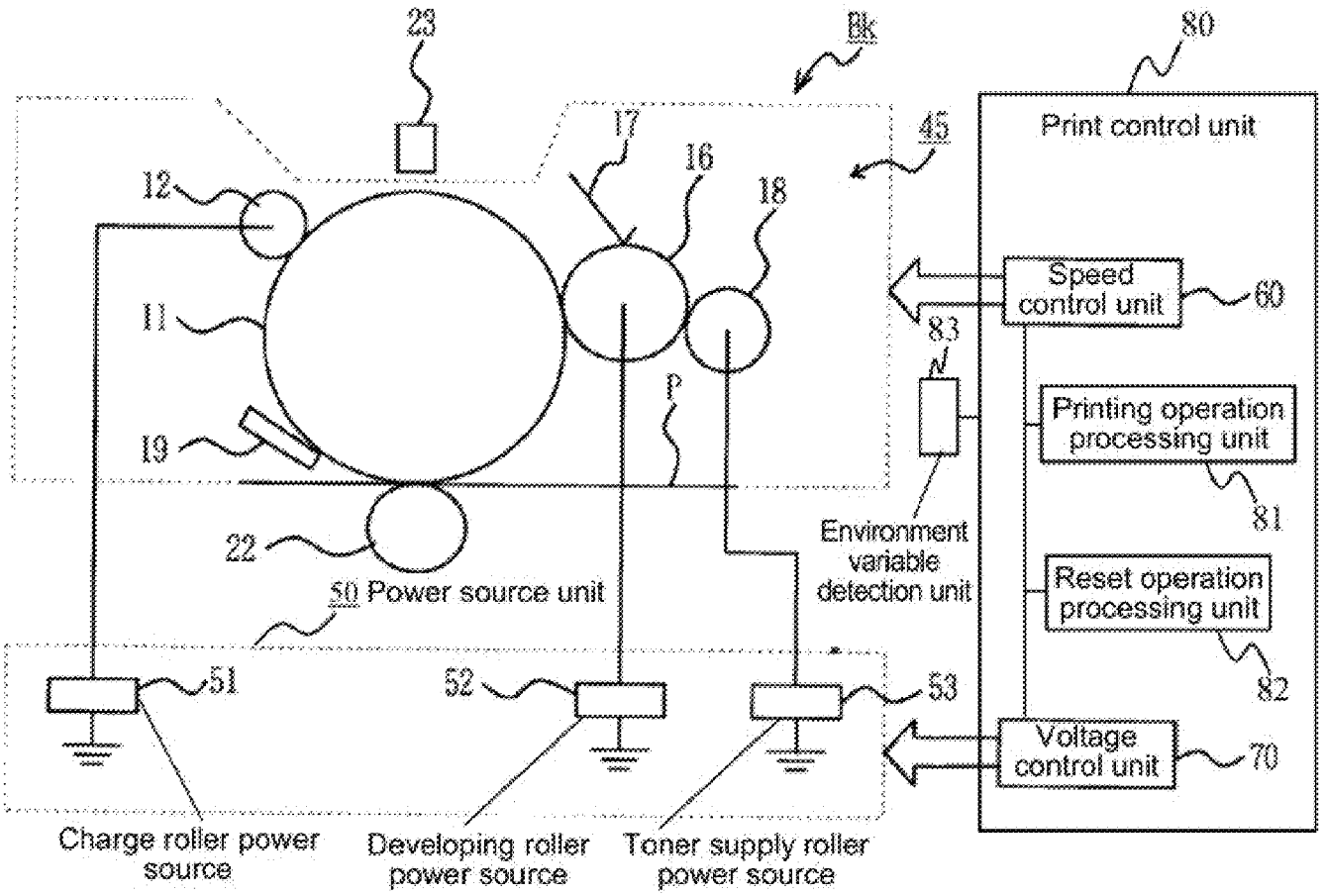
FIG. 1 is a schematic view showing an image forming unit according to a first embodiment of the present invention.
Figure 2:
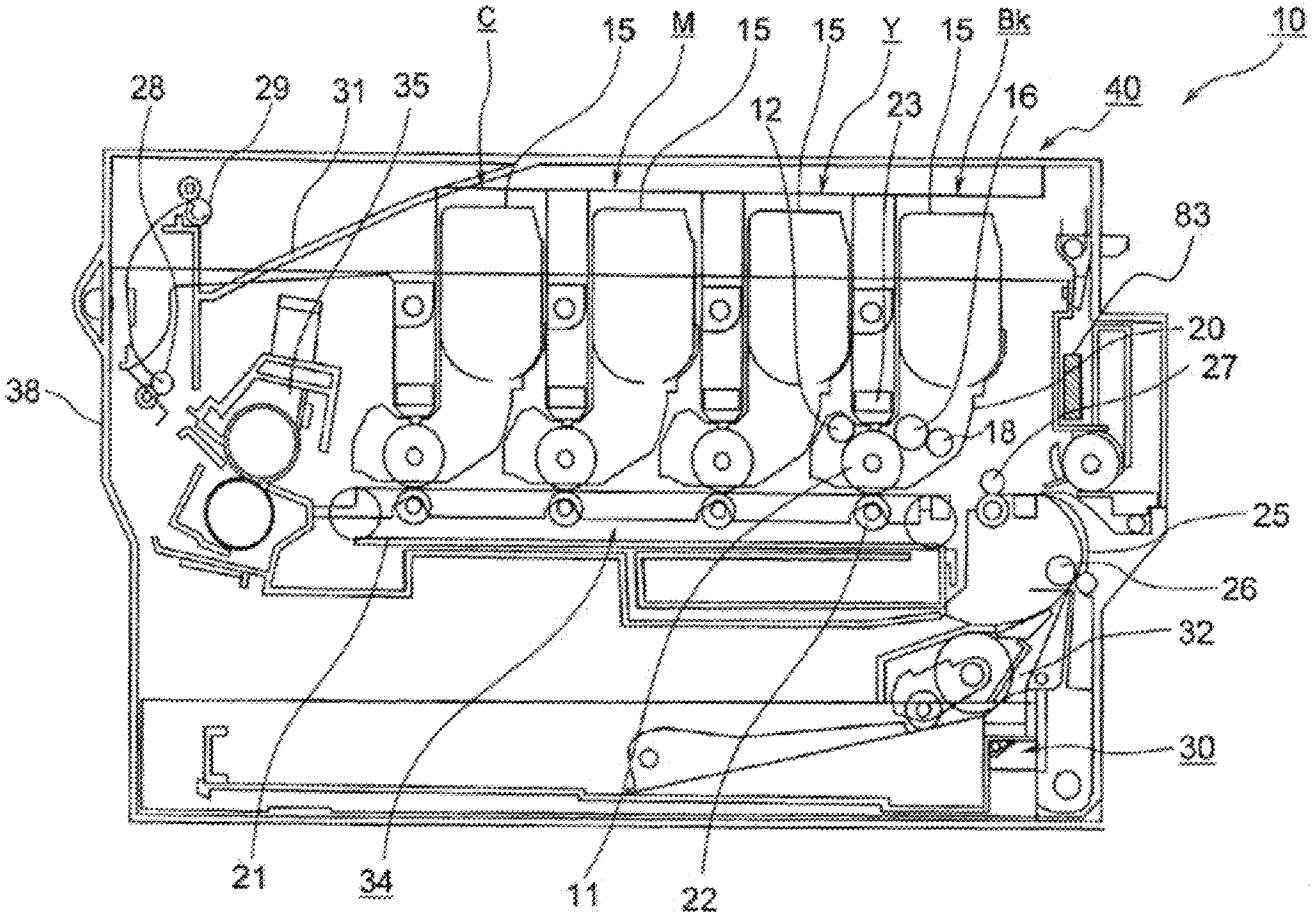
FIG. 2 is a schematic view showing a printer according to the first embodiment of the present invention.

A first embodiment of the present invention will be explained. FIG. 1 is a schematic view showing an image forming unit according to the first embodiment of the present invention. FIG. 2 is a schematic view showing a printer according to the first embodiment of the present invention.

As shown in FIGS. 1 and 2, a transportation path 25 is disposed in a main body of the printer or a printer main body 10 for transporting a sheet P as a medium. Transportation rollers 26 to 29 are disposed along the transportation path 25. Image forming units Bk (black), Y (yellow), M (magenta), and C (cyan) are arranged along the transportation path 25.

In the embodiment, each of the image forming units Bk, Y, M, and C includes a photosensitive drum 11 as an image supporting member. A transfer unit 34 is disposed below the image forming units Bk, Y, M, and C for transferring a toner image to the sheet P, and for transporting the sheet P between the image forming units Bk, Y, M, and C and the transfer unit 34. The transfer unit 34 constitutes a belt drive unit.

In the embodiment, each of the image forming units Bk, Y, M, and C further includes an LED (Light Emitting Diode) head 23 as an exposure device to face the photosensitive drum 11. A fixing device 35 as a fixing unit is disposed on a downstream side of the transfer unit 34 for fixing the toner image thus transferred to the sheet P.

In each of the image forming units Bk, Y, M, and C, when a drum motor as a drive unit drives the photosensitive drum 11 to rotate at a specific rotational speed, a charge roller 12 contacting with the photosensitive drum 11 at a specific pressure rotates in a direction opposite to a rotational direction of the photosensitive drum 11. Accordingly, the charge roller 12 applies a specific voltage to a surface of the photosensitive drum 11 for uniformly charging the surface of the photosensitive drum 11.

In the embodiment, the photosensitive drum 11 is an organic-type photosensitive member formed of an aluminum metal pipe as a conductive supporting member and a charge generation layer and a charge transportation layer as an optical conductive layer sequentially laminated on the aluminum metal pipe. The charge roller 12 is formed of a metal shaft and a semi-conductive rubber layer. When the LED head 23 exposes the surface of the photosensitive drum 11, a static latent image (not shown) as a static image is formed on the surface of the photosensitive drum 11.

In the embodiment, a developing device 45 is disposed adjacent to the photosensitive drum 11 for developing the static latent image to form a toner image. The developing device 45 includes a developing roller 16 as a developer supporting member for attaching toner as developer to the photosensitive drum 11; a developing blade 17 as a developer layer forming member or a developer regulating member for regulating a thickness of toner on the developing roller 16 to form a toner layer as a developer layer; and a toner supply roller 18 as a developer supplying member for supplying toner to the developing roller 16.

In the embodiment, the developing roller 16 is pressed against the photosensitive drum 11 with a specific pressure, and rotates in a direction opposite to the rotational direction of the photosensitive drum 11. Further, the toner supply roller 18 is pressed against the developing roller 16 with a specific pressure, and rotates in a direction the same as that of the developing roller 16.

In the embodiment, the developing roller 16 is formed of a metal shaft and a semi-conductive urethane rubber material. The developing blade 17 is formed of a thin plate having a thickness of, for example, 0.08 mm and a longitudinal length substantially the same as a width of an elastic member of the developing roller 16. Further, the developing blade 17 has one end portion in a longitudinal direction connected to a frame (not shown) and the other end portion having a surface situated slightly inside an edge of the developing blade 17 and contacting with the developing roller 16. A cleaning blade 19 as a cleaning device is disposed to contact with the photosensitive drum 11. The cleaning blade 19 is formed of an elastic member, and scrapes off toner remaining on the photosensitive drum 11.

In the embodiment, the photosensitive drum 11, the charge roller 12, and the developing device 45 are retained in a housing 20 constituting a main body of each of the image forming units Bk, Y, M, and C, or an image forming unit main body. A toner cartridges 15 as a developer container is disposed at an upper portion of the housing 20, and is arranged to be detachable relative to the housing 20.

In the embodiment, the transfer unit 34 includes a transfer belt 21 disposed to be freely movable, and transfer rollers 22 disposed to be freely rotatable and face the photosensitive drum 11*s*. A power source (not shown) applies a specific voltage to the transfer belt 21 and the transfer rollers 22 to transfer the toner image on each of the photosensitive drum 11*s* to the sheet P.

In the embodiment, the printer further includes a lower frame 38, and an upper frame 40 disposed to be freely rotatable relative to the lower frame 38 and provided with a stacker 38 for placing the sheet P discharged from the printer. A sheet cassette 30 as a sheet storage unit is disposed below the transfer unit 34 at an end portion of the transportation path 25 for storing the sheet P. A pickup member 32 is disposed on the sheet cassette 30 for picking up the sheet P.

In the embodiment, a power source unit 50 is connected to each of the image forming units Bk, Y, M, and C. The power source unit 50 includes a charge roller power source 51 as a charge device voltage applying unit for generating a bias with a polarity the same as that of toner and applying the bias to the charge roller 12; a developing roller power source 52 as a developer supporting member voltage applying unit for generating a bias with a polarity the same as or opposite to that of toner and applying the bias to the developing roller 16; and a toner supply roller power source 53 as a developer supplying member voltage applying unit for generating a bias with a polarity the same as that of toner and applying the bias to the toner supply roller 18. Note that it is possible to charge toner with an arbitrary polarity, and toner is charged with a negative polarity in the embodiment.

In the embodiment, the printer further includes a print control unit 80. The print control unit 80 includes a printing operation processing unit 81 and a reset operation processing unit 82. The print control unit 80 further includes a speed control unit 60 for controlling a printing speed with the printing operation processing unit 81 and the reset operation processing unit 82; and a voltage control unit 70 for controlling outputs of the charge roller power source 51, the developing roller power source 52, and the toner supply roller power source 53 of the power source unit 50.

An operation of the printer having the configuration described above will be explained next.

First, in each of the image forming units Bk, Y, M, and C, the charge roller 12 connected to the charge roller power source 51 charges the surface of the photosensitive drum 11 with a polarity and a potential the same as those of toner. When image data created with a writing control unit (not shown) of the print control unit 80 is sent to the LED head 23, an LED element (not shown) of the LED head 23 as a light emitting element selectively emits light, so that the static latent image is formed on the surface of the photosensitive drum 11 according to a print pattern.

In the next step, the toner supply roller 18 connected to the toner supply roller power source 53 abuts against the developing roller 16 connected to the developing roller power source 52, so that the toner supply roller 18 rotates to supply toner to the developing roller 16. Further, the developing blade 17 abuts against the developing roller 16, so that toner on the developing roller 16 is charged through friction relative to the developing blade 17. Note that the developing blade 17 is pressed against the developing roller 16 with a specific pressure for adjusting a thickness of a toner layer on the developing roller 16.

In the next step, the developing roller 16 abuts against the photosensitive drum 11. When the developing roller power source 52 applies a voltage controlled with the voltage control unit 70 to the developing roller 16, the developing roller 16 attaches toner to the static latent image, thereby forming the toner image.

When the pickup member 32 picks up the sheet P one by one, the transportation rollers 26 and 27 transport the sheet P, so that the sheet P is attached to the transfer belt 21 through static electricity. When the transfer belt 21 moves, the sheet P is transported between the transfer unit 34 and the image forming units Bk, Y, M, and C. As a result, the toner image in each color is transferred and overlapped on the sheet P through an electric field generated between the photosensitive drum 11 and the transfer rollers 22, thereby forming a toner image in colors.

In the next step, the fixing device 35 fixes the toner image in colors on the sheet P, thereby forming a color image. Afterward, the transportation rollers 28 and 29 transport the sheet P, so that the sheet P is placed on the stacker 31. Note that the cleaning blade 19 scrapes off toner remaining on the photosensitive drum 11.

In the embodiment, when the developing roller power source 52 generates a voltage V1 and the toner supply roller power source 53 generates a voltage V2, the voltage V1 has a polarity the same as that of the voltage V2. Further, the voltage V1 has an absolute value |V1| the same as or smaller than an absolute value |V2| of the voltage V2 ($|V1| \leqq |V2|$). It is arranged to adjust the absolute values |V1| and |V2| of the voltages V1 and V2 according to an environment where the printer is placed, an image forming condition such as a print duty, a usage state of the image forming units Bk, Y, M, and C, and the likes.

In the embodiment, a bias difference Vb is defined as a difference between the absolute values |V1| and |V2| of the voltages V1 and V2 ($Vb=|V2|-|V1|$). Even when the bias difference Vb is set at an optimal level, if a charge property or a flow property of toner changes due to the image forming condition, an excessive amount of toner may be attached to the developing roller 16. In this case, toner may be attached to the sheet P, thereby lowering image quality.

Figure 3:
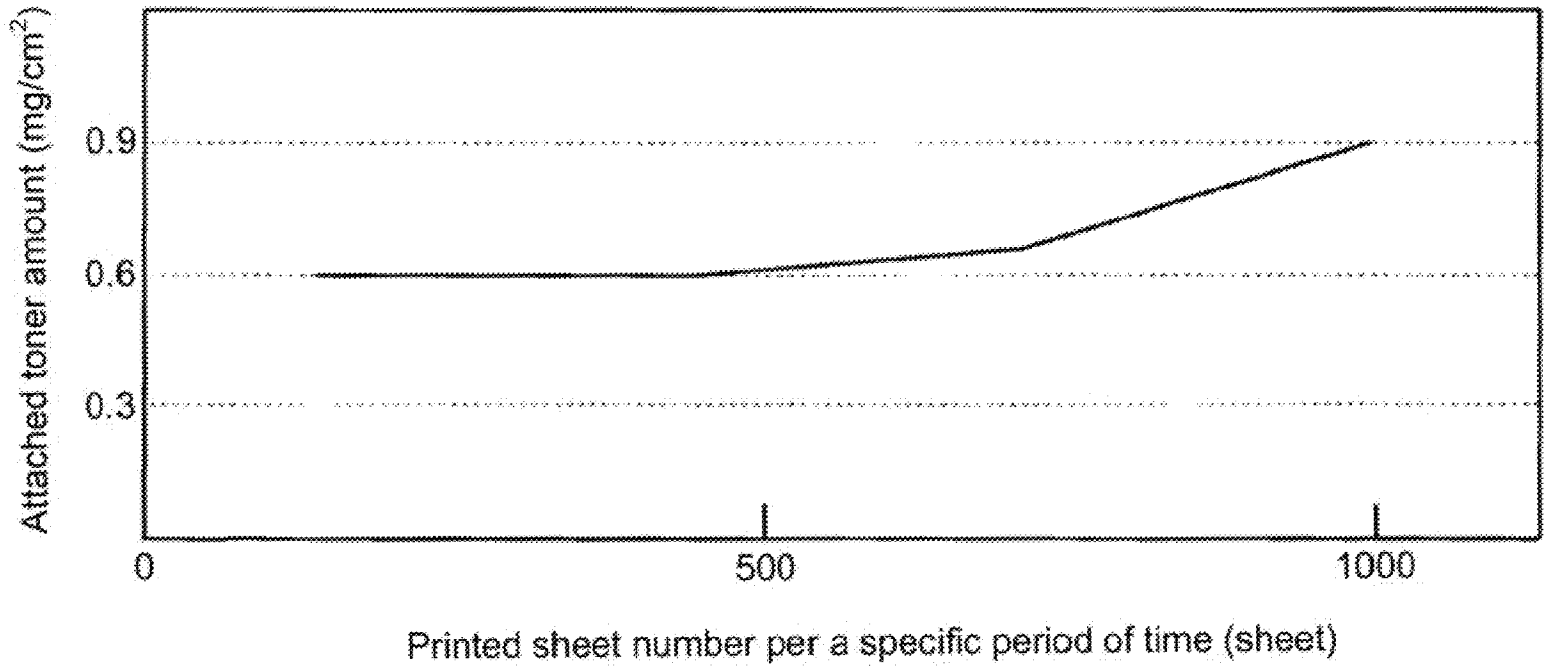
FIG. 3 is a graph showing an amount of toner on a developing roller at a low print duty according to the first embodiment of the present invention.

FIG. 3 is a graph showing an amount of toner on a developing roller at a low print duty according to the first embodiment of the present invention. In FIG. 3, the vertical axis represents a printed sheet number per a specific period of time, and the horizontal axis represents an attached toner amount.

Figure 4:
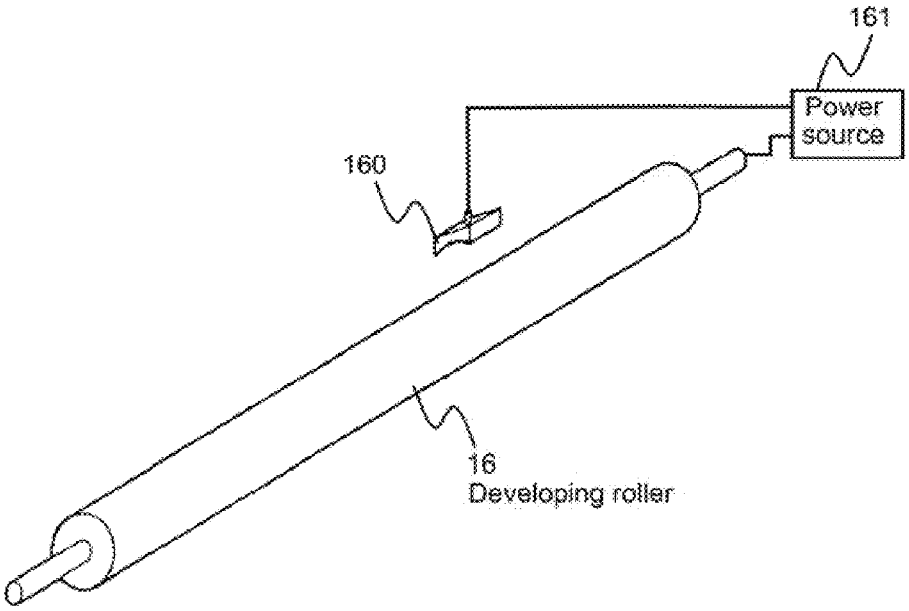
FIG. 4 is a schematic view showing a method of collecting toner on the developing roller according to the first embodiment of the present invention.

FIG. 4 is a schematic view showing a method of collecting toner on the developing roller 16 according to the first embodiment of the present invention.

An experiment was conducted for obtaining data shown in FIG. 3. In the experiment, a printer C9500 Series (a product of Oki Data Corporation) was used for printing sheets at a print speed of 30 ppm.

As shown in FIG. 4, when the printer did not perform a printing operation, a power source 161 applied a direct voltage of 300 V to a probe 160 having a surface area of 1 $cm^2$, so that toner on the developing roller 16 was collected. An amount of toner thus collected was measured from a difference in weights of the probe 160 before and after the collection. Note that a print duty represents a print density relative to a medium having the A4 size, and the low print duty represents a printed image having the print density less than 30%.

As shown in FIG. 3, when the printer continuously performed the printing operation at the low print duty, the attached toner amount on the developing roller 16 increased with the printed sheet number per the specific period of time (for example, 30 minutes). In the printing operation at the low print duty, after toner is supplied to the developing roller 16, a relatively small amount of toner is attached to the photosensitive drum 11. Accordingly, toner on the developing roller 16 is subject to repeated friction relative to the developing blade 17, thereby increasing a charge amount of toner.

Figure 5:
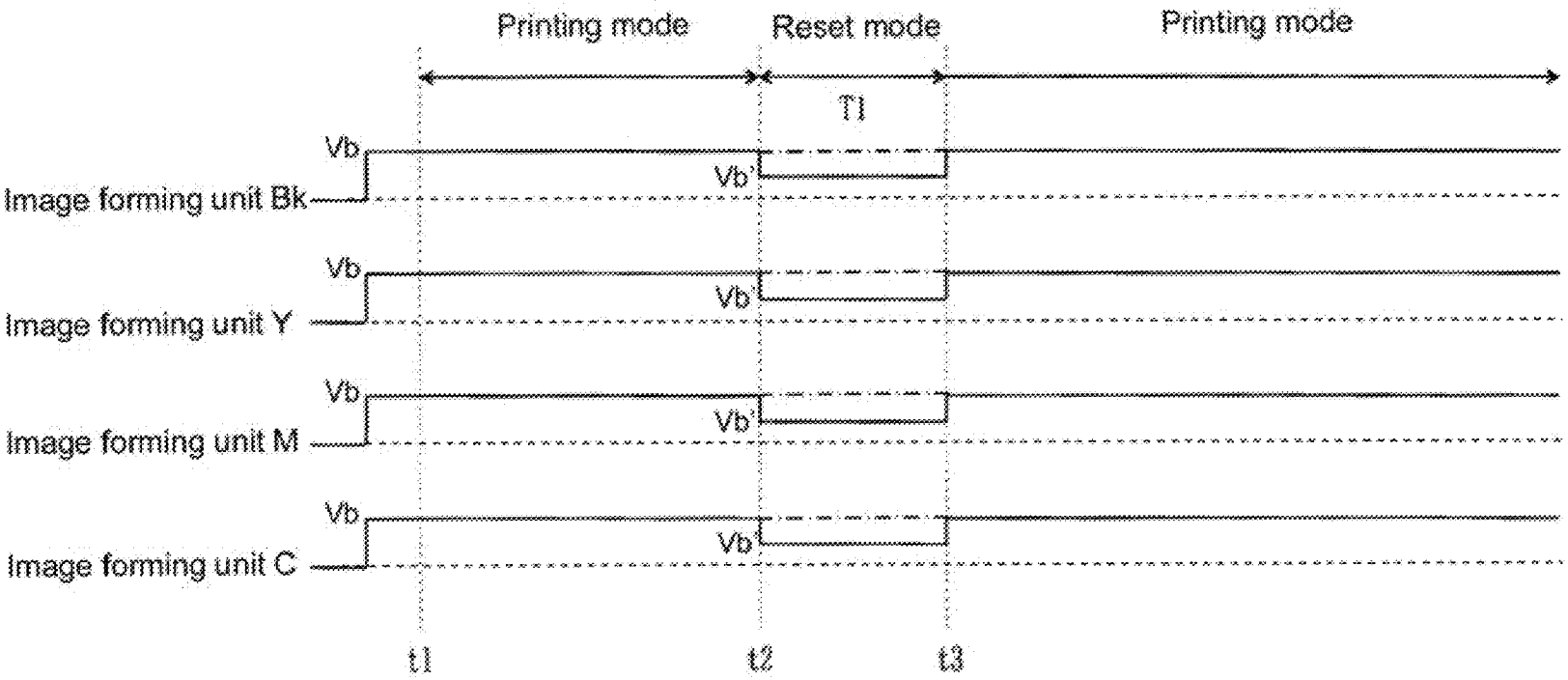
FIG. 5 is a time chart showing an operation of a print control unit according to the first embodiment of the present invention.

FIG. 5 is a time chart showing an operation of the print control unit 80 according to the first embodiment of the present invention.

In the embodiment, the printing operation processing unit 81 of the print control unit 80 performs a printing operation processing. More specifically, the printing operation processing unit 81 starts the printing operation according to a specific print job at a timing t1, thereby printing on at least one sheet. In the next step, when the printing operation of the print job is completed at a timing t2, the reset operation processing unit 82 of the print control unit 80 performs a reset operation processing, so that a mode is changed from a printing mode for performing the printing operation to a reset mode.

In the reset mode, the printing operation is not performed for a specific period of time T1. Further, toner on the developing roller 16 is replaced with new toner, and an attached amount of toner on the developing roller 16 is set to an optimal level. In the next step, the printing operation processing unit 81 changes the mode from the reset mode to the printing mode for performing the printing operation, so that the printing operation is performed again.

In the embodiment, the reset operation processing unit 82 controls the reset mode. In the reset mode, as compared with the printing mode, it is controlled to decrease the bias difference Vb between the absolute values |V1| and |V2| of the voltages V1 and V2 applied to the developing roller 16 and the toner supply roller 18, respectively. Accordingly, toner attached to the developing roller 16 tends to come off more easily, thereby reducing an amount of toner on the developing roller 16. The printing operation processing unit 81 controls the printing mode, so that the voltages V1 and V2, i.e., necessary biases, are applied to the developing roller 16 and the toner supply roller 18, respectively.

In the embodiment, when the specific period of time T1, in which the reset mode is maintained, becomes longer, it is possible to sufficiently replace toner on the developing roller 16, thereby making it possible to sufficiently reduce an attached amount of toner. When the specific period of time T1 becomes excessively long, however, printing performance may be lowered.

In consideration of the case described above, the specific period of time T1 is set to a period of time in which the developing roller 16 makes at least one rotation. Accordingly, it is possible to reduce an attached amount of toner by a specific amount as an amount of toner consumed when the developing roller 16 makes one rotation. Further, when the specific period of time T1 is set to the period of time in which the developing roller 16 makes at least one rotation, it is possible to obtain an effect uniformly over a whole surface of the developing roller 16 in a shortest period of time. It is confirmed that when an amount of toner attached to the developing roller 16 is reduced by more than 20%, it is possible to prevent toner from attaching to an area of a medium where an image is not formed. The specific amount may be properly adjusted according to an apparatus.

Figure 6:
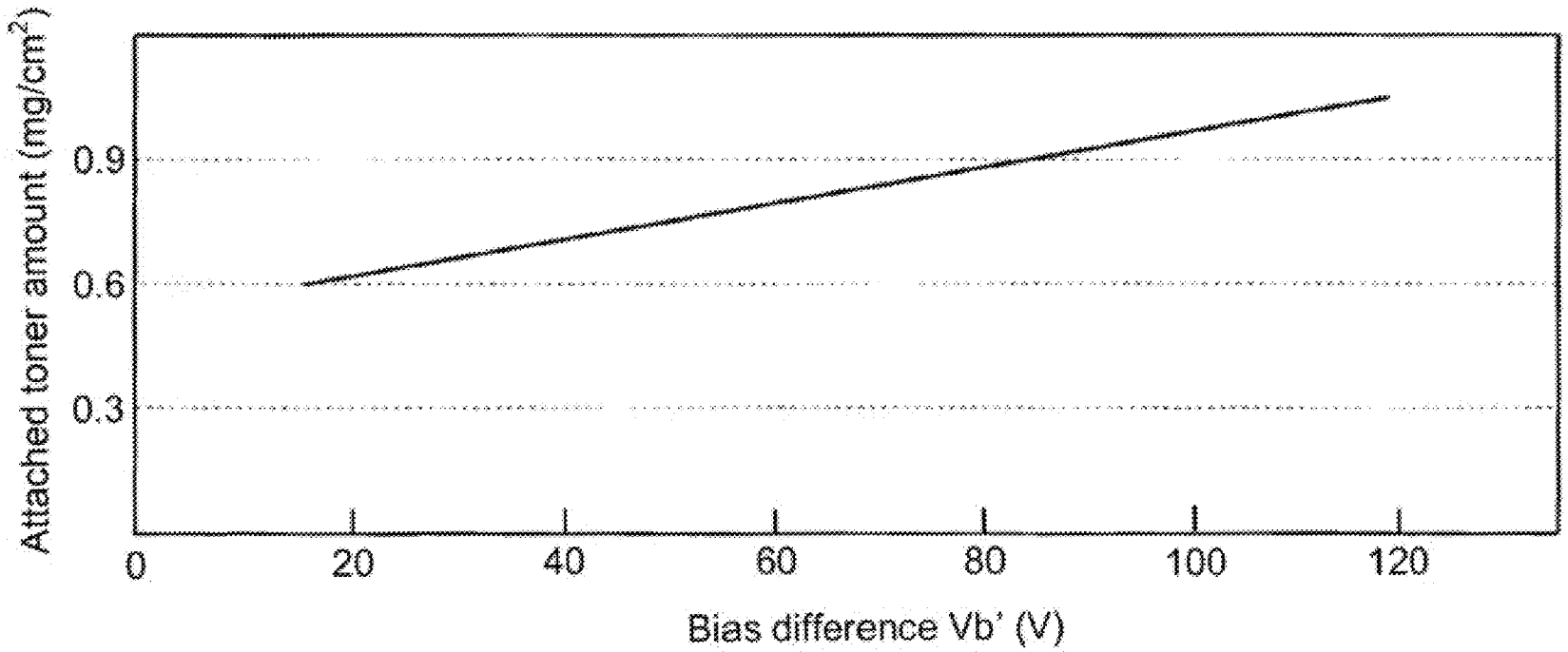
FIG. 6 is a graph showing a relationship between a bias difference and an amount of toner on the developing roller in a reset mode according to the first embodiment of the present invention.

The reset mode will be explained next in more detail. FIG. 6 is a graph showing a relationship between a bias difference Vb' and an amount of toner on the developing roller 16 in the reset mode according to the first embodiment of the present invention. In FIG. 6, the vertical axis represents an attached toner amount, and the horizontal axis represents the bias difference Vb'.

An experiment was conducted for obtaining data shown in FIG. 6. In the experiment, the printer C9500 Series (a product of Oki Data Corporation) was used for continuously printing 900 of sheets with the A4 size. A printed image was formed of a low print duty pattern. After the printing operation, the probe 160 was used to collect toner on the developing roller 16, and an amount of toner thus collected was measured. The procedure was repeated while the bias difference Vb' changed.

As shown in FIG. 6, there is a positive relationship between the bias difference Vb' and an amount of toner on the developing roller 16 in the reset mode. That is, when the bias difference Vb' decreases, it is possible to reduce the attached toner amount on the developing roller 16.

In the reset mode, in order to sufficiently reduce an attached amount of toner on the developing roller 16, it is preferred that the bias difference Vb' becomes smaller than a half of the bias difference Vb in the printing mode. It is confirmed that it is possible to reduce an attached amount of toner on the developing roller 16 by about 20 to 40% when the bias difference Vb' becomes smaller than a half of the bias difference Vb. The result may vary depending on conditions such as a lifetime of the photosensitive drum 11, an environmental condition where the printer is placed, and the likes.

In the embodiment, it is preferred that the bias difference Vb' in the reset mode becomes smaller than a half of the bias difference Vb in the printing mode for the following reason. As described above, FIG. 6 is a graph showing a relationship between the bias difference Vb' and an amount of toner on the developing roller 16 in the reset mode according to the first embodiment of the present invention.

As shown in FIG. 6, when the bias difference Vb' changes, an amount of toner on the developing roller 16 changes. Further, there is a proportional relationship between the bias difference Vb' and an amount of toner on the developing roller 16. When the bias difference Vb' is about 90 V, an amount of toner on the developing roller 16 is about 0.9 mg/cm$^2$. When an amount of toner on the developing roller 16 is reduced in the reset mode by about 20% relative to an amount of toner in the printing mode, the bias difference Vb' is about 45 V.

When the bias difference Vb' decreases, the toner supply roller 18 supplies toner with a smaller amount to the developing roller 16. For example, when a bias of 150 V is applied to the developing roller 16, and a bias of 200 V is applied to the toner supply roller 18, a potential difference between the developing roller 16 and the toner supply roller 18 becomes 50 V. Accordingly, toner charged with a negative potential moves from the toner supply roller 18 to the developing roller 16 through the potential difference of 50 V. When a bias of 180 V is applied to the toner supply roller 18, the potential difference becomes 30 V, thereby reducing an amount of toner moving from the toner supply roller 18 to the developing roller 16.

Further, as described above, when the bias difference Vb' decreases, toner attached to the developing roller 16 tends to come off. From the experimental result shown in FIG. 6 and the change in an amount of toner on the developing roller 16 relative to the bias difference Vb', when the bias difference Vb' in the reset mode becomes smaller than a half of the bias difference Vb in the printing mode, it is possible to reduce an amount of toner attached to the developing roller 16 by more than 20% relative to the printing mode.

In the embodiment, according to an instruction from the reset operation processing unit 82, the voltage control unit 70 controls the developing roller power source 52 to apply the voltage V1 to the developing roller 16, and controls the toner supply roller power source 53 to apply the voltage V2 to the toner supply roller 18, so that the difference between the voltages V1 and V2 becomes the bias difference Vb in the printing mode. In the reset mode, the voltage control unit 70 controls the developing roller power source 52 and the toner supply roller power source 53, so that the bias difference Vb' becomes smaller than the bias difference Vb in a range of $0 \leqq Vb' \leqq Vb \times 0.5$.

As described above, in the embodiment, when the print job is completed, the mode is switched from the printing mode to the reset mode, and the bias difference Vb' is set to a small level, thereby making it possible to reduce an attached amount of toner on the developing roller 16. As a result, it is possible to prevent toner from being attached to an area of the sheet P where an image is not formed, thereby improving image quality.

In the embodiment, every time when the print job is completed, the mode is switched from the printing mode to the reset mode. Alternatively, a number of printed sheets may be measured according to a count value of a drum counter (not shown) and the likes. When the number of printed sheets becomes a preset value, the mode is switched from the printing mode to the reset mode.

In the embodiment, as shown in FIGS. 1 and 2, the printer may be provided with a temperature sensor or a humidity sensor at a specific position as an environment variable detection unit 83 for sending environmental information of the print control unit 80 and detecting an environment variable such as a temperature or humidity of an environment where the printer is placed. In this case, according to a temperature or humidity detected with the environment variable detection unit, it is possible to change a frequency of switching the mode from the printing mode to the reset mode.

An example of changing the frequency of switching the mode will be explained in a case of the printer C9500 Series (a product of Oki Data Corporation). When humidity increases, a charge amount of toner decreases. Accordingly, the mode is switched from the printing mode to the reset mode less frequently. More specifically, when humidity exceeds 50%, a charge amount of toner decreases by 30%. Accordingly, the mode is switched from the printing mode to the reset mode less frequently by 30% relative to a normal condition.

Second Embodiment

A second embodiment of the present invention will be explained next. In the second embodiment, before the printing operation is completed, the mode is switched from the printing mode to the reset mode less frequently. In the second embodiment, a printer has a configuration similar to that in the first embodiment, and will be explained with reference to FIGS. 1 and 2. Components in the second embodiment similar to those in the first embodiment provide an effect similar to that in the first embodiment.

Figure 7:
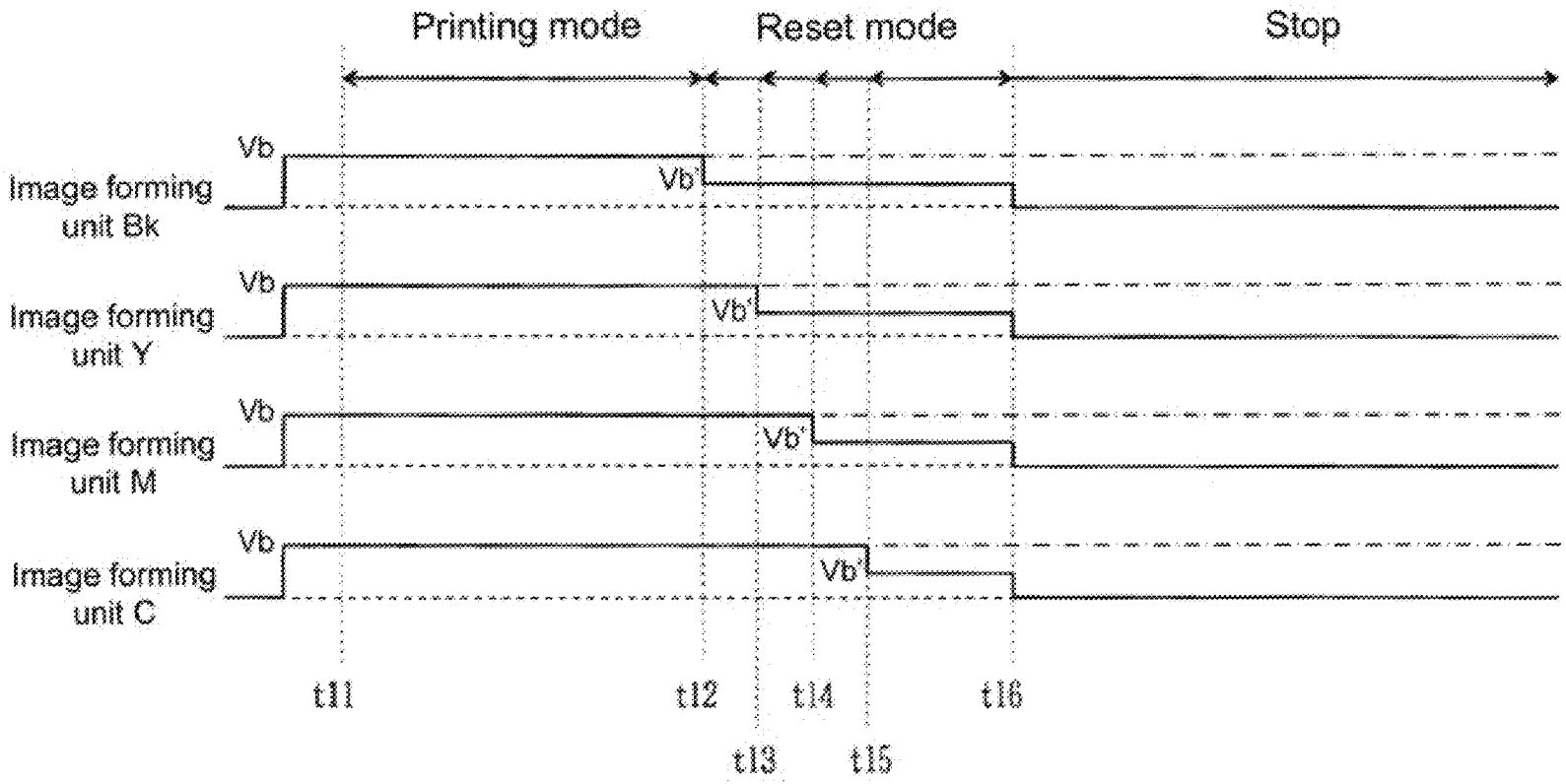
FIG. 7 is a time chart showing an operation of a print control unit according to a second embodiment of the present invention.

FIG. 7 is a time chart showing an operation of the print control unit 80 according to the second embodiment of the present invention.

In the embodiment, the printing operation processing unit 81 of the print control unit 80 starts the printing operation according to a specific print job at a timing t11, thereby printing on at least one sheet. In the next step, when the printing operation of the print job is completed, the reset operation processing unit 82 performs the reset operation processing. Accordingly, in the image forming unit Bk, Y, M, and C, the mode is sequentially changed from the printing mode to the reset mode at timings t12, t13, t14, and t15.

In the reset mode, the printing operation is not performed, and toner as developer on the developing roller 16 as the developer supporting member is replaced with new toner, and an attached amount of toner on the developing roller 16 is set to an optimal level. In the next step, the printing operation processing unit 81 stops the printing operation at a timing t16. At this moment, the voltage control unit 70 controls the charge roller power source 51 as the charge device voltage applying unit, the developing roller power source 52 as the developer supporting member voltage applying unit, and the toner supply roller power source 53 as the developer supplying member voltage applying unit to stop generating voltages.

As described above, in the embodiment, when the sheet P as a last medium of the print job passes through the image forming unit Bk, Y, M, and C, the mode is sequentially changed from the printing mode to the reset mode. Accordingly, it is possible to quickly replace toner on the developing roller 16 with new toner.

In the first and second embodiments, the printer is explained, and the present invention may be applicable to a copier, a facsimile, a multi-function product, and the likes.

The disclosures of Japanese Patent Application No. 2008-222037, filed on Aug. 29, 2008, and Japanese Patent Application No. 2009-171226, filed on Jul. 22, 2009, are incorporated in the application by reference.

While the invention has been explained with reference to the specific embodiments of the invention, the explanation is illustrative and the invention is limited only by the appended claims.

What is claimed is:

1. An image forming apparatus, comprising:

a developer supporting member for attaching and supporting developer charged with a specific polarity;

a developer supply member for supplying the developer to the developer supporting member;

a developer supporting member voltage applying unit for applying a first voltage to the developer supporting member;

a developer supplying member voltage applying unit for applying a second voltage to the developer supplying member, said second voltage having an absolute value being equal to or greater than that of the first voltage in a reset mode during a non-printing operation; and a reset operation processing unit for setting the reset mode over a specific period of time so that an absolute value of a first bias difference in the reset mode between the absolute values of the first voltage and the second voltage becomes smaller than an absolute value of a second bias difference in a printing operation between the absolute values of the first voltage and the second voltage.

2. The image forming apparatus according to claim 1, wherein said reset operation processing unit is arranged to switch to the reset mode when a print job is completed.

3. The image forming apparatus according to claim 1, wherein said reset operation processing unit is arranged to set the reset mode for the specific period of time in which the developer supporting member makes at least one rotation.

4. The image forming apparatus according to claim 1, further comprising a plurality of image forming units disposed along a direction that a medium is transported, said reset operation processing unit being arranged to switch the image forming units to the reset mode from an upstream side to a downstream side.

5. The image forming apparatus according to claim 1, further comprising an image supporting member.

6. The image forming apparatus according to claim 5, wherein said developer supporting member is arranged to attach the developer to a static latent image formed on a surface of the image supporting member to form a developer image.

7. The image forming apparatus according to claim 1, wherein said developer supplying member voltage applying unit is arranged to apply the second voltage having a polarity the same as that of the first voltage.

8. An image forming apparatus, comprising:

a developer supporting member for attaching and supporting developer charged with a specific polarity;

a developer supply member for supplying the developer to the developer supporting member;

a developer supporting member voltage applying unit for applying a first voltage to the developer supporting member;

a developer supplying member voltage applying unit for applying a second voltage to the developer supplying member; and a reset operation processing unit for setting a reset mode during a non-printing operation over a specific period of time so that an absolute value of a. first bias difference in the reset mode between absolute values of the first voltage and the second voltage becomes smaller than an absolute value of a second bias difference in a printing operation between the absolute values of the first voltage and the second voltage, wherein said reset operation processing unit is arranged to set the reset mode so that the absolute value of the first bias difference is equal to or greater than zero, and is equal to or smaller than a half of the absolute value of the second bias difference.

9. The image forming apparatus according to claim 8, wherein said developer supplying member voltage applying unit is arranged to apply the second voltage equal to or greater than the first voltage in the reset mode.

10. The image forming apparatus according to claim 9, wherein said developer supplying member voltage applying unit is arranged to apply the second voltage having a polarity the same as that of the first voltage.

11. An image forming apparatus, comprising:

a developer supporting member for attaching and supporting developer charged with a specific polarity;

a developer supply member for supplying the developer to the developer supporting member;

a developer supporting member voltage applying unit for applying a first voltage to the developer supporting member;

a developer supplying member voltage applying unit for applying a second voltage to the developer supplying member; and a reset operation processing unit for setting a reset mode during a non-printing operation over a specific period of time so that an absolute value of a first bias difference in the reset mode between absolute values of the first voltage and the second voltage becomes smaller than an absolute value of a second bias difference in a printing operation between the absolute values of the first voltage and the second voltage, wherein said reset operation processing unit is arranged to switch to the reset mode when a number of printed sheets exceeds a specific value.

12. The image forming apparatus according to claim 11, wherein said developer supplying member voltage applying unit is arranged to apply the second voltage equal to or greater than the first voltage in the reset mode.

13. The image forming apparatus according to claim 12, wherein said developer supplying member voltage applying unit is arranged to apply the second voltage having a polarity the same as that of the first voltage.

14. An image forming apparatus, comprising:

a developer supporting member for attaching and supporting developer charged with a specific polarity;

a developer supply member for supplying the developer to the developer supporting member;

a developer supporting member voltage applying unit for applying a first voltage to the developer supporting member;

a developer supplying member voltage applying unit for applying a second voltage to the developer supplying member;

a reset operation processing unit for setting a reset mode during a non-printing operation over a specific period of time so that an absolute value of a first bias difference in the reset mode between absolute values of the first voltage and the second voltage becomes smaller than an absolute value of a second bias difference in a printing operation between the absolute values of the first voltage and the second voltage; and an environmental variable detection unit for detecting a variable of an environment where the image forming apparatus is placed, said reset operation processing unit being arranged to change a frequency of switching to the reset mode according to the variable of the environment.

15. The image forming apparatus according to claim 14, wherein said environmental variable detection unit includes at least one of a temperature sensor and a humidity sensor.

16. The image forming apparatus according to claim 14, wherein said developer supplying member voltage applying unit is arranged to apply the second voltage equal to or greater than the first voltage in the reset mode.

17. The image forming apparatus according to claim 16, wherein said developer supplying member voltage applying unit is arranged to apply the second voltage having a polarity the same as that of the first voltage.

* * * * *